US005524901A

United States Patent [19]

Bison et al.

[11] Patent Number: 5,524,901

[45] Date of Patent: Jun. 11, 1996

[54] SPORT TARGET APPARATUS

[76] Inventors: Darrel L. Bison, 17 N. Bullmoose, Chandler, Ariz. 85224; Theodore R. Carney, 5811 W. Tempe Ave., Visalia, Calif. 93278

[21] Appl. No.: 449,241

[22] Filed: May 24, 1995

[51] Int. Cl.[6] ..... A63B 63/00

[52] U.S. Cl. ..... 273/400; 273/26 A; 473/197

[58] Field of Search ..... 273/26 A, 29 A, 273/398, 400, 410, 411, 404, 181 R, 181 A, 181 F, 181 J, 181 K

[56] References Cited

U.S. PATENT DOCUMENTS

| | | | |
|---|---|---|---|
| 331,756 | 12/1885 | Baker | 273/127 R |
| 1,540,670 | 6/1925 | Vidmer | 273/181 F |
| 2,069,822 | 2/1937 | Douglas | 273/404 |
| 2,224,962 | 12/1940 | Hines | 273/105 |
| 2,615,715 | 10/1952 | Moore | 273/29 |
| 3,227,449 | 1/1966 | Schwab | 273/55 |
| 3,741,549 | 6/1973 | Wilson | 273/181 A |
| 4,127,267 | 11/1978 | Bay et al. | 273/26 A |
| 4,183,524 | 1/1980 | Kifferstein et al. | 273/29 A |
| 4,556,219 | 12/1985 | Tillery | 273/181 F |
| 4,583,744 | 4/1986 | Tolliver et al. | 273/404 |
| 4,643,423 | 2/1987 | Wright | 273/26 A |
| 5,007,645 | 4/1991 | Weigi et al. | 273/181 F |
| 5,088,740 | 2/1992 | Peterson | 273/410 |
| 5,351,948 | 10/1994 | Thomas | 273/26 A |

FOREIGN PATENT DOCUMENTS

| | | | |
|---|---|---|---|
| 2135587 | 9/1984 | United Kingdom | A63B 69/36 |

OTHER PUBLICATIONS

Brochure with postmark of Apr. 12, 1995 by Par–Buster of Tulsa Oklahoma.

Advertisement for Indoor/Outdoor Practice Net in Golf Day Catalog 119A No Publication Date.

*Primary Examiner*—William H. Grieb

*Attorney, Agent, or Firm*—Schmeiser, Olsen & Watts

[57] ABSTRACT

A sport target apparatus has a target on a back panel disposed at a down angle for stopping the travel of a ball directed at the target. The apparatus includes a bottom panel which defines a ball retention area for collecting the balls, and one or more flaps for receiving the balls. The apparatus is lightweight, portable, easy to set up and take down, durable, and resistant to environmental effects.

18 Claims, 1 Drawing Sheet

SPORT TARGET APPARATUS

BACKGROUND OF THE INVENTION

1. Field of the Invention

This invention generally relates to sports equipment, and more specifically relates to a target apparatus for use with a variety of sport balls, including golf, baseball, tennis, football, and soccer.

2. Description of the Related Art

If a person desires to increase his or her proficiency in playing a particular sport, practice is generally required. For sports that use a ball, the skill of the player is directly proportional to the player's ability to direct the ball to a desired target. To increase proficiency at directing the ball, a person may actually play the sport, or may choose to practice by simulating one or more of the actions that are required in directing the ball. Many different practice devices are known to help in developing proficiency in directing the ball in a variety of sports. For example, U.S. Pat. No. 4,127,267 "Collapsible Frame With Hanging Net Ball Arresting Apparatus" (issued Nov. 28, 1978 to Bay et al.) discloses a net ball arresting apparatus with a collapsible frame for use with a number of sports such as tennis and baseball; U.S. Pat. No. 5,351,948 "Portable Ball Receiver With Integrated Ball Supporting Platform" (issued Oct. 4, 1994 to Thomas) discloses a portable net apparatus with an integral T-ball stand for batting practice; U.S. Pat. No. 4,643,423 "Pitching Target" (issued Feb. 17, 1987 to Wright) discloses a screen with a target supported by a self-supporting frame in conjunction with a trough, so that pitched baseballs that impact the screen will fall down into the trough; U.S. Pat. No. 4,183,524 "Practice Net" (issued Jan. 15, 1980 to Kifferstein et al.) discloses a practice net for tennis that is attached to a garage door and, when deployed, rebounds tennis balls that are directed into the practice net; and U.S. Pat. No. 3,227,449 "Draped-Web Target Device" (issued Jan. 4, 1966 to Schwab) discloses a target device that may be suspended and that has a curtain with a lower hopper, such that the curtain stops the forward motion of a ball (such as a softball) and causes the ball to fall within the hopper. All of the patents referenced above are incorporated herein by reference.

Other targeting practice devices that are used specifically for golf are also known. For example, U.S. Pat. No. 5,007,645 "Golf Practice Device" (issued Apr. 16, 1991 to Weigi et al.) discloses a golf net that is attached on one end to the floor of a garage and is attached at the other end to the top of the garage door so the net allows opening of the garage door. This device allows a golfer to direct golf balls to the net from either inside or outside the garage. U.S. Pat. No. 3,741,549 "Golf Target" (issued Jun. 26, 1973 to Wilson) discloses a self-standing target with a pocket for receiving chip shots. U.K. Pat. No. GB 2 135 587A "Practice Net for Golf Ball Driving" (issued Sep. 5, 1984 to Wood) discloses a net with multiple pockets for receiving a golf ball, with the accuracy of the drive determined by which pocket (if any) the golf ball enters. These patents are incorporated herein by reference. In addition, other golf practice nets are commercially known, such as the Indoor-Outdoor Practice Net offered by Golf Day, a mail order house that sells golf equipment. This practice net comprises a self-standing frame with a backstop net and a lower ball arresting net. Other commercially available self-supporting golf practice nets are manufactured and sold by Par-Buster of Tulsa, Okla.

Each of the known sport nets have inherent disadvantages. For example, for the units that are self-supporting, a frame (typically of metal) is required, increasing the bulk and weight of the unit, making the unit less portable, and sometimes making portability by one person impossible. Many have only a backstop, with no sides or top or other means for containing the ball. Most are made of a fabric net, which may deteriorate from exposure to the elements. The units that do have sides and/or a top are much bulkier to transport and require a larger space for use. A few have a trough or hopper for receiving the balls once their forward motion is stopped. However, each of the known prior art sport nets have failings in one or more areas such as failing to make the unit collapsible, easily transportable by one person, relatively small in size allowing for use in a wide variety of locations, easily set up by suspending the unit on supports, easily removed and collapsed by removing the unit from the supports, able to arrest the motion of a ball in several directions, able to retain many balls within a ball retention area, able to direct a ball that hits a front lip area into the ball retention area, and resistant to elements such as ultraviolet light, moisture, mildew, etc.

Therefore, there existed a need to provide a sport target apparatus that is relatively lightweight and easily transportable by one person in a relatively small space, can be easily deployed and taken down by one person, and provides other specific features and advantages not known in the prior art.

SUMMARY OF THE INVENTION

According to the present invention, a sport target apparatus has a back panel disposed at a down angle with a target, a bottom portion for retaining the balls, and one or more flaps for arresting the motion of the balls. The apparatus is suitably constructed of webbed polyethylene material to achieve a high strength and good resistance to environmental factors.

BRIEF DESCRIPTION OF THE DRAWING

The preferred exemplary embodiment of the present invention will hereinafter be described in conjunction with the appended drawings, where like designations denote like elements, and.

DETAILED DESCRIPTION OF A PREFERRED EXEMPLARY EMBODIMENT

Figure 1:
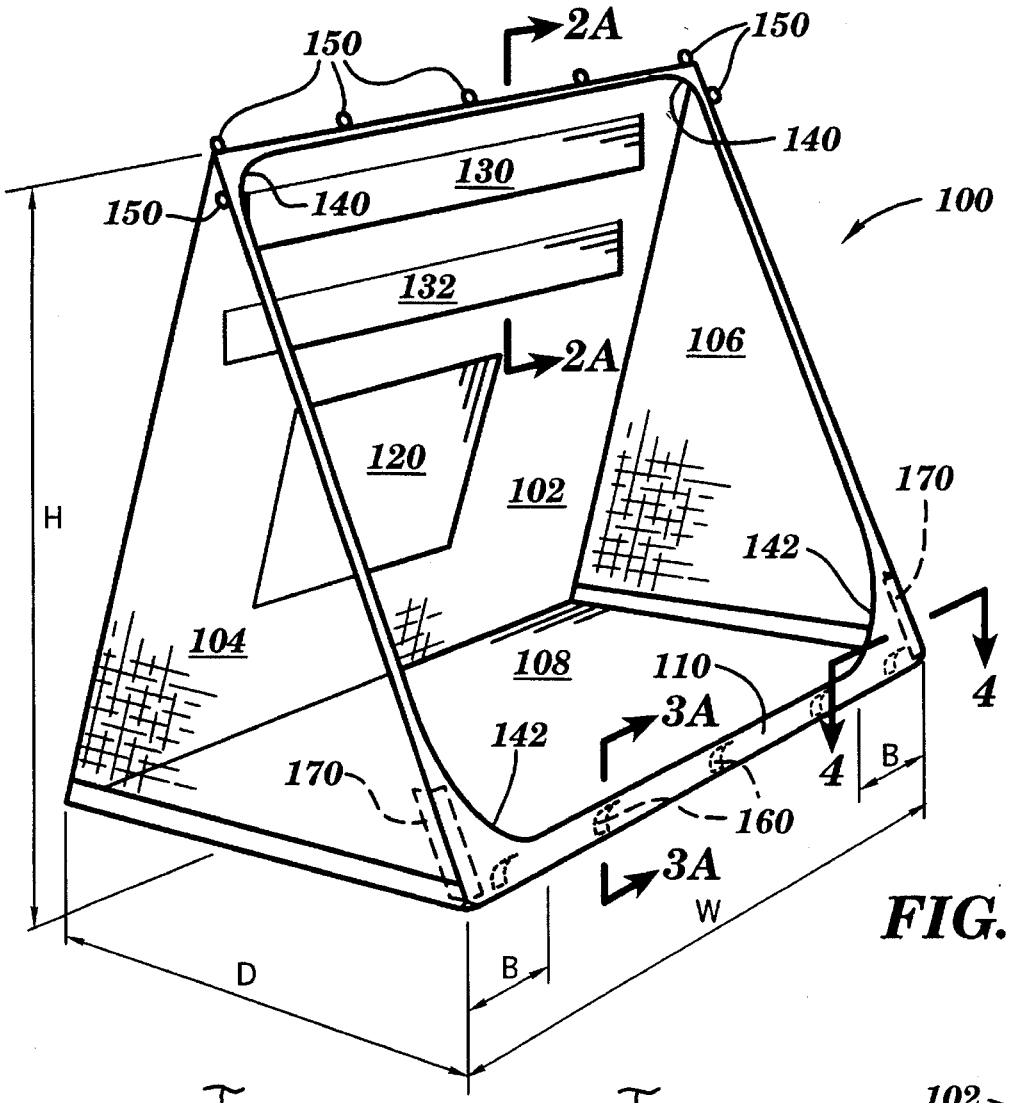
FIG. 1 is a perspective view of the sport target apparatus in accordance with the present invention.

Referring to FIG. 1, a sport target apparatus 100 in accordance with an exemplary embodiment of the present invention comprises a back panel 102 with a target 120, a bottom panel 108, a left side panel 104, a right side panel 106, and a front lip 110. These panels 102108 and front lip 110 are attached together to form a target apparatus for a ball used in sports. While the present invention may be used with a variety of different balls used in different sports, the preferred exemplary embodiment described herein is for a specific configuration used by a golfer to practice driving golf balls. The unique construction and features of the sport target in accordance with the present invention allow the sport target apparatus to be easily transported and set up with a minimum of time and effort, and provide superior features and performance when compared to known sport targets.

Back panel 102 acts as a backstop for a ball directed at the sport target apparatus 100, and stops the travel of the ball. Back panel 102 is disposed at a suitable down angle which tends to prevent the ball from bouncing out of the apparatus once it strikes back panel 102. Back panel 102 is preferably constructed of a suitable webbed fabric material, but may be formed of other solid fabrics or materials as well. The side edges of back panel 102 are suitably attached to side panels 104 and 106, while the bottom edge is suitably attached to bottom panel 108. The top edge of back panel 102 includes a suitable edging for the material used for back panel 102, but preferably comprises a thick ribbing material attached to the top edge of back panel 102 for providing the required rigidity and strength. In addition, back panel 102 may include one or more attachment devices 150 (e.g., eye loops or hooks) for suspending target apparatus 100. Back panel 102 suitably includes a target area 120 and one or more retention flaps 130, 132.

Target area 120 provides a visual target for the user, and suitably comprises a solid patch of material. Target area 120 in the preferred embodiment is a vinyl sheet material, but any flexible material may be used for target area 120, including, without limitation, a variety of fabrics made of either natural or synthetic fibers (or a combination thereof), plastic sheet material, etc. Target area 120 may be suitably attached to back panel 102 using a variety of attachment means and devices, including sewing target area 120 to back panel 102.

Figure 2A:
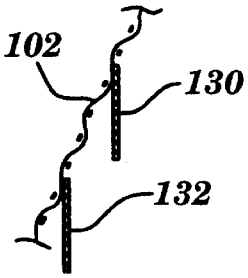
FIG. 2A is a cross-sectional side view of a portion of the back panel of the sport target apparatus of FIG. 1 taken along the line 2A—2A.
Figure 2B:
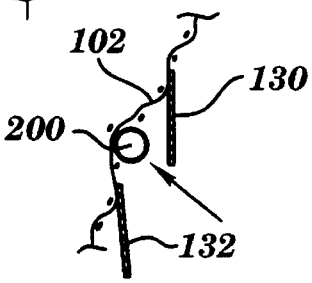
FIG. 2B is a cross-sectional side view of the back panel of FIG. 2A showing a golf ball impacting the back panel.
Figure 2C:
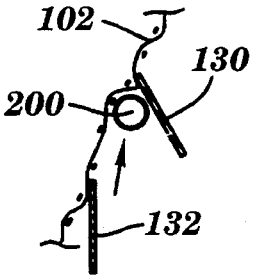
FIG. 2C is a cross-sectional side view of the back panel of FIG. 2A showing a golf ball being stopped by a flap attached to the back panel.

Retention flaps 130 and 132 are suitably rectangular flaps disposed horizontally along back panel 102 to receive a ball that is directed at a specific area of back panel 102. For the particular golf ball apparatus shown in the figures, flaps 130 and 132 prevent a golf ball that strikes back panel 102 above target area 120 from exiting the top of apparatus 100. For other applications (not shown), retention flaps 130 and 132 may be attached to back panel 102 in different configurations for receiving a ball. Retention flaps 130 and 132 are suitably constructed of the same webbed material as back panel 102, but could also be constructed of any sort of flexible material, such as the same plastic or fabric material used in target area 120. Each of flaps 130 and 132 have both an upper and a lower edge. One of the upper and lower edges is attached horizontally to back panel 102, while the other edge is not attached. For the specific case of an apparatus 100 used for driving golf balls, retention flaps 130 and 132 are attached at their upper edge, while the lower edges hang free, as illustrated in FIGS. 2A–2C. This configuration allows a golf ball that is hit above target area 120 to be stopped between a flap and the back panel, resulting in the ball falling within the apparatus 100. For example, referring to FIG. 2B, a golf ball 200 that strikes back panel 102 at an upward angle causes back panel 102 to flex, which absorbs most of the horizontal component of the force of golf ball 200, thereby directing golf ball 200 in an upward direction along its slope. The vertical component of force drives golf ball 200 upward until it is forced between flap 130 and back panel 102, as shown in FIG. 2C. The relatively large inertia of flap 130 compared to the force of golf ball 200 causes flap 130 to stop the upward motion of golf ball 200, resulting in golf ball 200 falling directly downward from flap 130 into a ball retention area defined by bottom panel 108.

Retention flaps 130 and 132 for a target apparatus configured to receive golf balls (e.g., apparatus 100 of FIG. 1) may be attached to back panel 102 at the far side edges, or may hang free. The retention flaps (e.g., 130 and 132) could take on a number of different configurations depending on the specific ball size used. For example, the number of flaps could be decreased or increased for particular applications. The size and orientation of the flaps could also change. For example, retention flaps that are much larger than the flaps shown in FIGS. 1 and 2A–2C could have their bottom and side edges attached to back panel 102, with the upper edge hanging free to define a pocket large enough, for example, to receive a football. With this configuration, a number of flaps could be attached at various positions on back panel 102 to test the accuracy of each throw, i.e., to see if the thrower could hit a particular pocket. In similar fashion, the retention flaps could change in size, number, orientation and configuration to receive one or more baseballs, softballs, tennis balls, or soccer balls.

Side panels 104 and 106 enclose the sides of apparatus 100 to prevent balls that enter therein from exiting the sides. Side panels 104 and 106 are suitably constructed of the same webbed material as back panel 102, but may be made of other fabric or material as well, as discussed above in relation to acceptable materials for target area 120. Side panels 104 and 106 suitably have a substantially triangular shape, with the back edge of each triangle attached to back panel 102 and the bottom edge of each triangle attached to bottom panel 108. A reinforcing member 172 is attached to the lower edge of side panel 104, and a corresponding reinforcing member 174 is attached to the lower edge of side panel 106. Reinforcing members 172 and 174 are suitably constructed to be somewhat rigid but flexible, providing structural support for the side panels while still allowing apparatus 100 to be easily collapsed. A suitable material for reinforcing members 104 and 106 is 30 mil thick high-density flexible polyethylene sheet material. The front edge of side panels 104 and 106 may be any suitable edging for the material used to construct the side panels, but is preferably a thick ribbing material to give the front edges of side panels 104 and 106 added rigidity and strength. One way to provide a suitable ribbed edge is to sew a bungee cord into the front seam of the fabric of which side panels 104 and 106 are made. The bungee cords in the front seam of side panels 104 and 106 allow apparatus 100 to give somewhat to allow for adjusting the tautness of side panels 104 and 106 to provide the desired rigidity, tension and strength.

The lower portion of the front edge of side panels 104 and 106 is attached to front lip 110 via a curved or angled portion 142 that helps prevent balls that enter apparatus 100 from bouncing outside of the apparatus. In addition to curved or angled portions 142, the upper portion of the front edge of side panels 104 and 106 is attached to the top edge of back panel 102 via a curved or angled portion 140, preferably at the ribbed top portion of back panel 102. Curved or angled portions 140 also help to retain balls within apparatus 100.

Bottom panel 108 is attached to the bottom edges of back panel 102, side panels 104 and 106, and front lip 110, and defines a ball retention area where balls that enter apparatus 100 may fall and be retained until retrieved. The ball retention area provides an advantage by allowing a user to simply collapse apparatus 100 on top of balls within the ball retention area, making the transporting of the balls very easy. Thus, for example, when a golfer has completed his or her practice and desires to leave, he or she can collapse apparatus 100 on top of dozens of balls within the ball retention area, making the balls very easy to carry within the collapsed apparatus and storing the balls until the next use of apparatus 100. As with the other panels discussed to this point, bottom panel 108 is suitably constructed of the same webbed material as back panel 102, but may be made of other fabric or material as well.

Figure 3A:
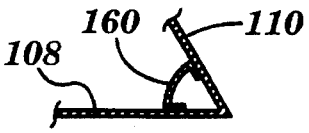
FIG. 3A is a cross-sectional side view of the front lip of the sport target apparatus of FIG. 1 taken along the line 3A—3A.
Figure 3B:
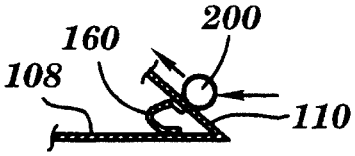
FIG. 3B is a cross-sectional side view of the front lip of FIG. 3A showing the deflection of the front lip when impacted with a golf ball.
Figure 4:
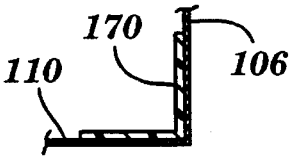
FIG. 4 is a cross-sectional top view of a front corner of the sport target apparatus of FIG. 1 taken along the line 4—4.

The construction and configuration of front lip 110 provides significant advantages over the prior art. Referring to FIG. 3A, the bottom edge of front lip 110 is coupled to the front edge of bottom panel 108. Front lip 110 suitably comprises a reinforcing member 176 suitably attached to an outer layer of fabric 112. Reinforcing member 176 is suitably of the same material as reinforcing members 172 and 174 (e.g., 30 mil thick high-density flexible polyethylene sheet material). Outer layer of fabric 112 suitably comprises the same woven or other material that forms back panel 102. Front lip 110 is held in a slightly rearwardly sloped position by one or more flexible supports 160 in order to guide balls that strike front lip 110 into apparatus 100 (FIG. 3A). Flexible supports 160 hold front lip 110 in a near-upright position, yet allow front lip 110 to flex (i.e., collapse) if struck by a ball. Flexible support 160 is attached to front lip 110 and to bottom panel 108, and suitably comprises a flexible yet semi-rigid material such as plastic or rubber, such as the material used in reinforcing members 172, 174 and 176 (e.g., 30 mil high-density flexible polyethylene sheet material). Referring now to FIG. 3B, when a golf ball 200 strikes front lip 110, a portion of the horizontal component of force exerted on front lip 110 by golf ball 200 causes flexible support 160 to bend, increasing the angle of front lip 110 to direct golf ball 200 into apparatus 100. Once golf ball 200 has passed from front lip 110 into apparatus 100, flexible support 160 returns to its original shape, thereby returning front lip 110 to its original position, as shown in FIG. 3A. The flexible yet resilient nature of front lip 110 provides a distinct advantage over the prior art by helping to direct balls that strike front lip 110 into apparatus 100 rather than causing the ball to bounce back toward the user.

Target apparatus 100 is self-hanging, allowing a user to easily deploy the apparatus by suspending it from one or more attachment devices 150 using appropriate suspension means, such as rope or bungee cords. The spacing and placement of attachment devices 150 allows the width or height of apparatus 100 to be varied during the deployment according to the user's specific needs. In addition, target apparatus 100 is very lightweight, suitably less than fifteen pounds. The light weight and easy deployment of apparatus 100 allow the user to easily transport and set up the apparatus in many places where most prior art sport nets could not be traditionally used, such as inside a house, garage, office, or other building; in a back yard; in the mountains while camping; in a parking lot; or any other place which allows suspending apparatus 100. The self-hanging nature of apparatus 100 further allows it to be used with either a self-supporting frame (not shown) constructed of appropriate materials (e.g., steel or PVC pipe, aluminum tubing, wood, etc.), or to be deployed in other non-traditional places, such as between two trees, between two poles, or within the opening of a garage door.

The specific materials used in constructing apparatus 100 suitably provide for an apparatus that is collapsible to a relatively small size, sufficiently light to be carried by one person, sufficiently strong to withstand the hardest anticipated impact from a ball without damage, resistant to breakdown and deterioration caused by environmental factors (e.g., ultraviolet light, moisture, mildew, etc.), and sufficiently strong and rigid to allow apparatus 100 to be deployed by hanging apparatus 100 from one or more attachment devices 150 (e.g., eye loops or hooks) attached along the top edge of apparatus 100. The preferred webbed material from which apparatus 100 is suitably constructed is a high density polyethylene monofilament, woven into a warp knitting stable fabric, with a weave that has a shade percentage of approximately 67% (i.e., that allows approximately 33% of the light to pass through), and that has an ultraviolet (UV) resistance that allows the fabric to retain 80% of its strength after 10,000 hours of UV exposure. Additional properties of the preferred webbed material are shown in Table I below:

TABLE I

| Parameter | | Minimum | Average |
|---|---|---|---|
| Grab Tensile Strength | Warp | 168 lbs. | 195 lbs. |
| | Weft | 280 lbs. | 318 lbs. |
| Mullen Burst Strength | | 355 psi | 398 psi |
| Tear Strength | Warp | 291 lbs. | |
| | Weft | 32.6 lbs. | |
| Weight | | | 7.5 oz./square yard |

The specific properties of the woven fabric described herein make the target apparatus 100 more suitable for receiving sports balls when compared to netting found in the prior art. The weave and weight of the woven fabric cause a near complete arrest of the ball's velocity with little or no noise, stopping the ball in-flight without bouncing back toward the user. These benefits are most apparent in golf applications, where the ball is hard and small, and the velocity of the ball is relatively high.

A target apparatus 100 in accordance with the present invention could be used in a variety of different applications, including: a driving target for golf (sees description above); a pitching target for baseball or softball; a hitting target for T-ball; a serving target for tennis; a kicking or throwing target for football; and a kicking target for soccer. The dimensions of apparatus 100 may be varied as required according to the particular sport and ball, and according to the particular size and needs of the user. Referring again to FIG. 1, height H of apparatus 100 is suitably in the range of 3 to 12 ft., more preferably in the range of 5 to 10 ft., and most preferably in the range of 6 to 8 ft. Width W of apparatus 100 is suitably in the range of 3 to 20 ft., more preferably in the range of 6 to 14 ft., and most preferably in the range of 8 to 10 ft. Depth D of apparatus 100 is suitably in the range of 1 to 8 ft., more preferably in the range of 2 to 6 ft., and most preferably in the range of 3 to 4 ft. Apparatus 100 illustrated in the figures (i.e., configured for driving a golf ball) is suitably approximately 9'4" wide, approximately 7'4" high, and approximately 3'4" deep, but these dimensions are presented for illustrative purposes, and may be varied within the scope of the present invention.

While the invention has been described in its preferred exemplary embodiment, it is to be understood that the words which have been used are words of description rather than limitation, and that changes may be made within the purview of the appended claims without departing from the true scope and spirit of the invention in its broader aspects.

What is claimed is:

1. A sport target apparatus comprising:

a back panel disposed at a downward angle;

a bottom panel coupled to the back panel and defining a ball retention area within the apparatus; and at least one flap having a plurality of edges and attached to the back panel by at least one of the edges, disposed to receive a ball between the flap and the back panel.

2. The apparatus of claim 1 further comprising lip means coupled to a front edge of the bottom panel for partially collapsing when the ball impacts the lip means, for directing the ball within the ball retention area, and for returning to its previous position once the ball is directed into the ball retention area.

3. The apparatus of claim 1 wherein the back panel includes a target area.

4. The apparatus of claim 1 further comprising means coupled to the back panel for suspending the apparatus.

5. The apparatus of claim 1 wherein the back panel and the bottom panel comprise a webbed polyethylene fabric that is resistant to deterioration caused by moisture and ultraviolet light.

6. The apparatus of claim 1 wherein the height of the apparatus is in the range of 3 to 12 ft., the width of the apparatus is in the range of 3 to 20 ft., and the depth of the apparatus is in the range of 1 to 8 ft.

7. A sport target apparatus comprising:

a back panel disposed at a downward angle;

a bottom panel coupled to the back panel and defining a ball retention area within the apparatus; and lip means coupled to a front edge of the bottom panel for partially collapsing when a ball impacts the lip means, for directing the ball within the ball retention area, and for returning to its previous position once the ball is directed into the ball retention area.

8. The apparatus of claim 7 wherein the back panel includes a target area.

9. The apparatus of claim 7 further comprising means coupled to the back panel for suspending the apparatus.

10. The apparatus of claim 7 wherein the back panel and the bottom panel comprise a webbed polyethylene fabric that is resistant to deterioration caused by moisture and ultraviolet light.

11. The apparatus of claim 7 wherein the height of the apparatus is in the range of 3 to 12 ft., the width of the apparatus is in the range of 3 to 20 ft., and the depth of the apparatus is in the range of 1 to 8 ft.

12. A relatively lightweight, collapsible, portable, self-hanging, golf practice apparatus comprising, in combination:

a back panel disposed at a downward angle including a target area;

at least one flap having a plurality of edges and attached to the back panel by at least one of the edges, disposed to receive a golf ball between the flap and the rear panel;

a bottom panel coupled to the back panel and defining a ball retention area within the apparatus;

at least one side panel coupled to the rear panel and to the bottom panel;

lip means coupled to a front edge of the bottom panel for partially collapsing when the golf ball impacts the lip means, for directing the golf ball within the ball retention area, and for returning to its previous position once the golf ball is directed into the ball retention area.

13. The apparatus of claim 12 wherein the back panel includes a top edge and a bottom edge, the back panel being disposed at a downward angle whereby the top edge of the back panel is more foreward and the bottom edge is more rearward such that the back panel at least partially offsets the motion of a sport ball hitting the back panel.

14. The apparatus of claim 12 wherein the at least one flap has an above edge and a below edge, the above edge being secured to the back panel and the below edge being substantially unsecured such that the flap hangs essentially downwardly and forms a space between a rear surface of the flap and a front surface of the back panel, such that the flap will arrest the upward motion of a ball impacting the back panel near the flap and traveling into the space, the flap having a predetermined weight and dimension to substantially stop the upward motion of the ball, causing the ball to fall from the space to the ball retention area.

15. The apparatus of claim 12 further comprising at least one corner means coupled to the side panel for retaining the golf ball within the apparatus once the golf ball has entered the apparatus.

16. The apparatus of claim 12 further comprising means coupled to the back panel for suspending the apparatus.

17. The apparatus of claim 12 wherein the back panel, the bottom panel, and the side panel comprise a webbed polyethylene fabric that is resistant to deterioration caused by moisture and ultraviolet light.

18. The apparatus of claim 12 wherein the height of the apparatus is in the range of 6 to 8 ft., the width of the apparatus is in the range of 8 to 10 ft., and the depth of the apparatus is in the range of 3 to 4 ft.

* * * * *